US012410575B2

(12) United States Patent
Lipscomb

(10) Patent No.: US 12,410,575 B2
(45) Date of Patent: Sep. 9, 2025

(54) EROSION CONTROL SECURING APPARATUS AND METHOD

(71) Applicant: WESTERN GREEN, LLC, Evansville, IN (US)

(72) Inventor: Chad Lipscomb, Evansville, IN (US)

(73) Assignee: Western Green, LLC, Evansville, IN (US)

( * ) Notice: Subject to any disclaimer, the term of this patent is extended or adjusted under 35 U.S.C. 154(b) by 0 days.

(21) Appl. No.: 17/767,320

(22) PCT Filed: May 28, 2021

(86) PCT No.: PCT/US2021/034727
§ 371 (c)(1),
(2) Date: Apr. 7, 2022

(87) PCT Pub. No.: WO2021/243131
PCT Pub. Date: Dec. 2, 2021

(65) Prior Publication Data

US 2022/0372723 A1 Nov. 24, 2022

Related U.S. Application Data

(60) Provisional application No. 63/031,768, filed on May 29, 2020.

(51) Int. Cl.
*E02D 17/20* (2006.01)
*E02D 5/80* (2006.01)

(52) U.S. Cl.
CPC ..... *E02D 5/801* (2013.01); *E02D 17/202* (2013.01); *E02D 2200/1671* (2013.01); *E02D 2600/30* (2013.01)

(58) Field of Classification Search
CPC ..... E02D 5/801; E02D 17/202; E02D 2200/1671; E02D 5/80; A01G 13/0293
See application file for complete search history.

(56) References Cited

U.S. PATENT DOCUMENTS 2,603,319 A * 7/1952 Dyche ..... E21B 10/44 52/157
4,543,972 A 10/1985 Bennett et al.
6,715,384 B1 4/2004 Kozak
(Continued)

FOREIGN PATENT DOCUMENTS

DE 102011014880 A1 9/2012
WO 2016020631 A2 2/2016

OTHER PUBLICATIONS

International Search Report and Written Opinion issued in counterpart PCT Application No. PCT/US2021/034727 dated Aug. 25, 2021 (fourteen (14) pages).

*Primary Examiner* — Sean D Andrish
(74) *Attorney, Agent, or Firm* — E. Eric Mills; Thomas R. Parker, II; Maynard Nexsen PC

(57) ABSTRACT

An erosion control securing apparatus and method is disclosed. For example, an erosion control securing device is provided that includes a main shaft with a hexagonal-shaped head portion at its proximal end and a coil portion at its distal end. In one example, the coil portion of the erosion control securing device includes three turns. Further, a method of using the presently disclosed erosion control securing device for securing erosion control products is provided.

17 Claims, 16 Drawing Sheets

(56) References Cited

U.S. PATENT DOCUMENTS

| | | | | |
|---|---|---|---|---|
| 7,044,031 | B1 | 5/2006 | Mullen | |
| 2004/0148877 | A1* | 8/2004 | Roberts | E02D 5/80 52/155 |
| 2012/0217709 | A1 | 8/2012 | Christofius et al. | |
| 2017/0218593 | A1 | 8/2017 | Butterworth et al. | |
| 2021/0048055 | A1* | 2/2021 | Brown | E02D 5/801 |
| 2022/0098815 | A1* | 3/2022 | Zhou | E04B 1/34347 |

* cited by examiner

EROSION CONTROL SECURING APPARATUS AND METHOD

CROSS REFERENCE TO RELATED APPLICATIONS

The presently disclosed subject matter is a 35 U.S.C. § 371 U.S. national phase entry of International Application No. PCT/US2021/034727 having an international filing date of May 28, 2021, which is related to and claims priority to U.S. Provisional Patent Application No. 63/031,768 entitled "Erosion Control Securing Apparatus and Method" filed on May 29, 2020; the entire disclosures of which are incorporated herein by reference.

TECHNICAL FIELD

The presently disclosed subject matter relates generally to the installation and performance of erosion control products and more particularly to an erosion control securing apparatus and method.

BACKGROUND

Erosion control is important to the environment and its inhabitants. Not only does severe erosion threaten plant and animal life, economic concerns are triggered when commercial and infrastructure facilities are disrupted or harmed.

On land areas that are susceptible to erosion, therefore, it may be necessary to provide some kind of erosion control system. In one example, erosion control matting or blankets may be laid out over the land area. One issue is keeping this material in place in areas having slopes and channels The erosion control matting or blankets may be secured in place by the use of securing devices, such as pins, pegs, or staples. However, a drawback of such devices is that they can be easily removed, may not be reliable and/or may not be able to be easily installed, which can lead to failure of the erosion control system.

Accordingly, there remains a need for improved erosion protection that is reliable and convenient.

SUMMARY

The following presents a simplified summary of the invention in order to provide a basic understanding of some aspects of the invention. This summary is not an extensive overview of the invention. It is not intended to identify key or critical elements of the invention or to delineate the scope of the invention; its sole purpose is to present concepts of the invention in a simplified form as a prelude to the more detailed description that is subsequently presented.

In some embodiments, the presently disclosed subject matter may provide an erosion control securing apparatus and method. For example, an erosion control securing device may be provided that includes a main shaft with a hexagonal-shaped head portion at its proximal end and a coil portion at its distal end. In one example, the coil portion of the erosion control securing device may include three turns. Further, a main feature of the presently disclosed erosion control securing device may be that the hexagonal-shaped head portion is sized and shaped to engage with a standard hexagonal shaped drive tool, such as a standard hex socket that may be driven by a drill and/or socket wrench.

In some embodiments, the presently disclosed erosion control securing apparatus and method provide a coil portion that may include three turns and wherein the beginning of the coil portion (i.e., beginning of the first turn) may have a starting radius, then the radius of the coil portion may symmetrically increase to a maximum radius at the second turn, and then the radius may symmetrically decrease back to the starting radius at the ending of the coil portion (i.e., ending of the third turn).

In some embodiments, the presently disclosed erosion control securing apparatus may include a main shaft having a main shaft proximal end and a main shaft distal end; a head portion at the main shaft proximal end, the head portion being substantially hexagonal in shape; and a coil portion at the main shaft distal end.

In one example, the erosion control securing apparatus may include a coil portion having three turns, with the first of the three turns having a first radius, the second of the three turns having a radius larger than the first radius, and the third of the three turns having a radius about the same as the first radius.

In one example, the main shaft, the head portion, and the coil portion of the erosion control securing apparatus may be connected in a substantially continuous matter. Further, the main shaft, the head portion, and the coil portion may be substantially tubular or rod-like.

In one example, a head transition segment may be between the head portion and the main shaft proximal end, and the main shaft may be arranged substantially normal to the plane of the head portion.

In one example, a coil transition segment may be between the main shaft distal end and the proximal end of the coil portion, a tip may be at the distal end of the coil portion, and a tip transition segment may be between the distal end of the coil portion and the proximal end of the tip.

In one example, the head portion may be formed by adjoining segments, the adjoining segments may include a terminal end segment next to four central segments next to a head transition segment, the head transition segment may be connected to the main shaft, wherein the head transition segment may be spaced apart from the terminal end segment.

In one example, the head transition segment may include three adjoining segments, the first of the three adjoining segments may be connected to one of the four central segments, the second of the three adjoining segments may be about the same length as the first of the three adjoining segments, and the last of the three adjoining segments may be connected to the main shaft.

In some embodiments, the presently disclosed erosion control securing system and kit may include an erosion control securing kit may include a securing device having a main shaft having a main shaft proximal end and a main shaft distal end; a head portion at the main shaft proximal end, the head portion being substantially hexagonal in shape; and a coil portion at the main shaft distal end; and a rotational drive mechanism for installing the securing device.

In one example, the rotational drive mechanism may include a socket with a body having a recess on one side, and the recess may be substantially hexagonal in shape and dimensioned to receive the head portion. In one example, the body has a socket wrench receiver on the side opposing the one side In one example, the substantially hexagonal recess may include a central recess that is substantially circular. In one example, an arrangement of engaging features may be provided within the substantially hexagonal recess and surrounding the central recess. In one example, a magnet may be provided within the central recess.

In some embodiments, the presently disclosed method for using an erosion control securing system may include the steps of: providing a securing device comprising: a main shaft having a main shaft proximal end and a main shaft distal end; a head portion at the main shaft proximal end, the head portion being substantially hexagonal in shape; and a coil portion at the main shaft distal end; providing a matting material; laying out the matting material over an area; and installing the securing device into the matting material to secure the matting material to the area, wherein the head portion is on one side of the matting material and the main shaft and coil portion are on the opposing side of the matting material.

Other features will be readily apparent to those skilled in the arts, techniques and equipment relevant to the present invention from a review of the Drawings and Detailed Description.

BRIEF DESCRIPTION OF DRAWINGS

Figure 1:
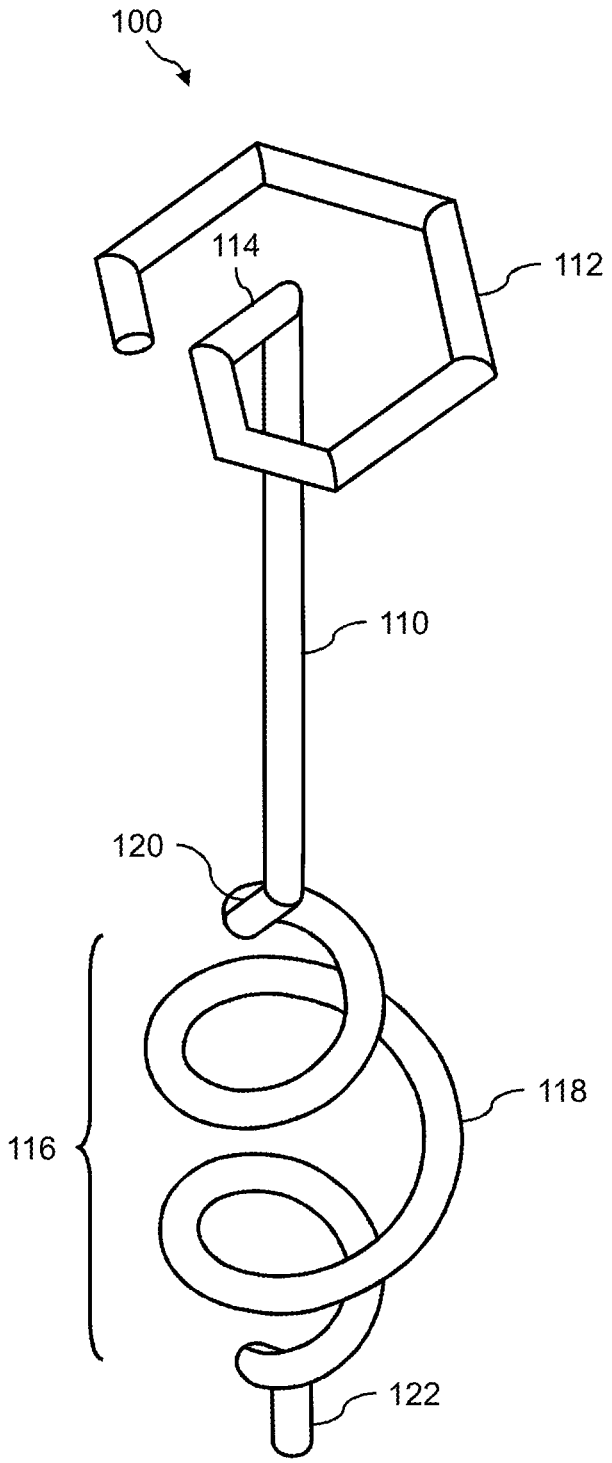
Figure 2A:
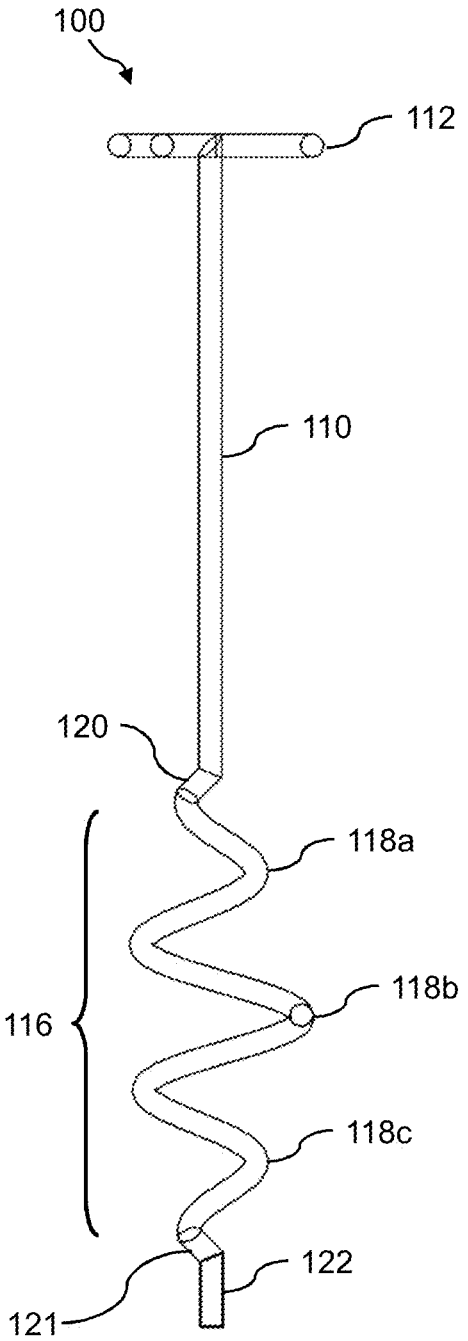
Figure 2B:
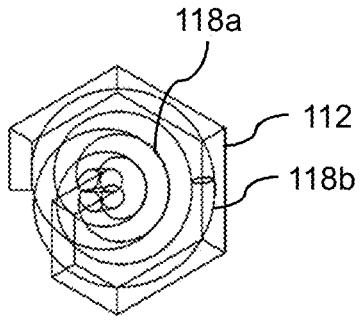
Figure 2C:
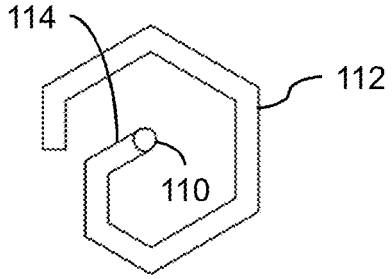
Figure 3:
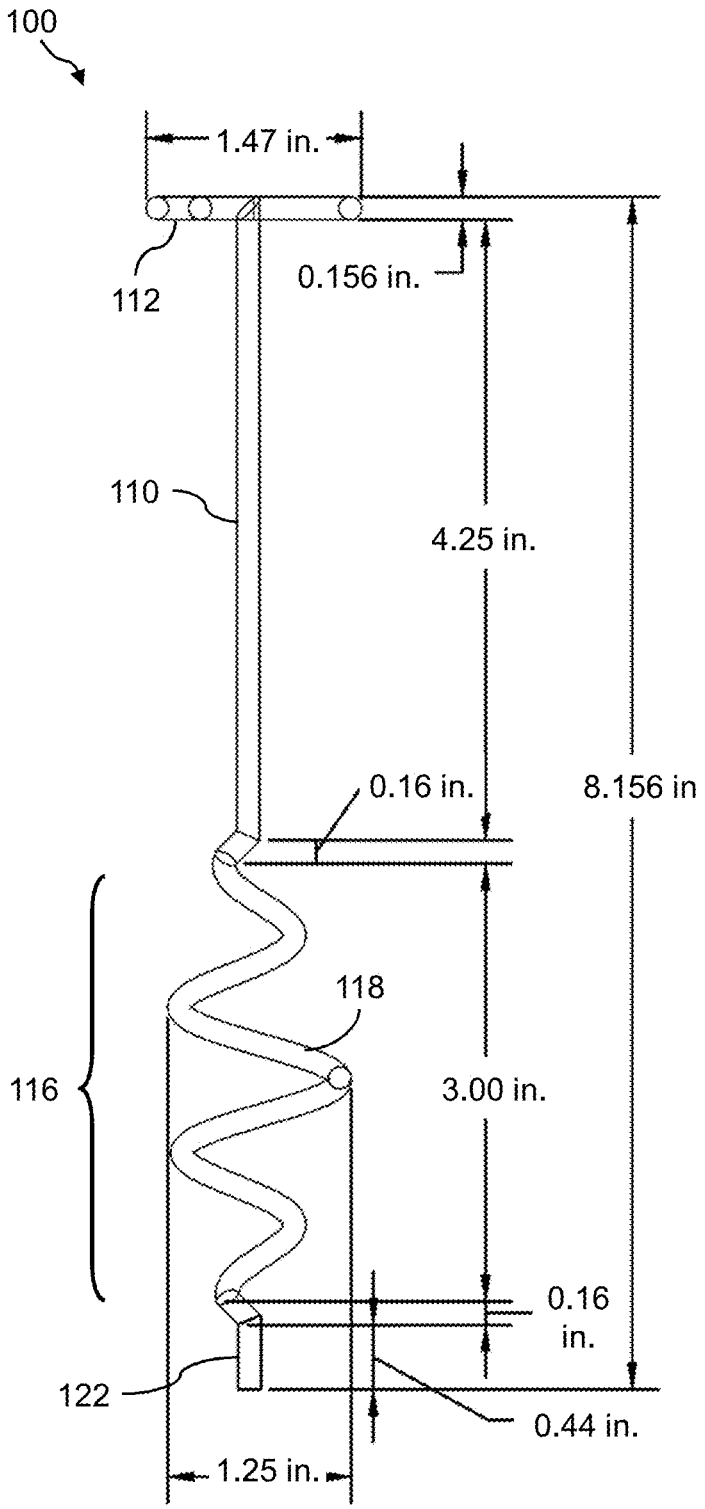
Figure 4A:
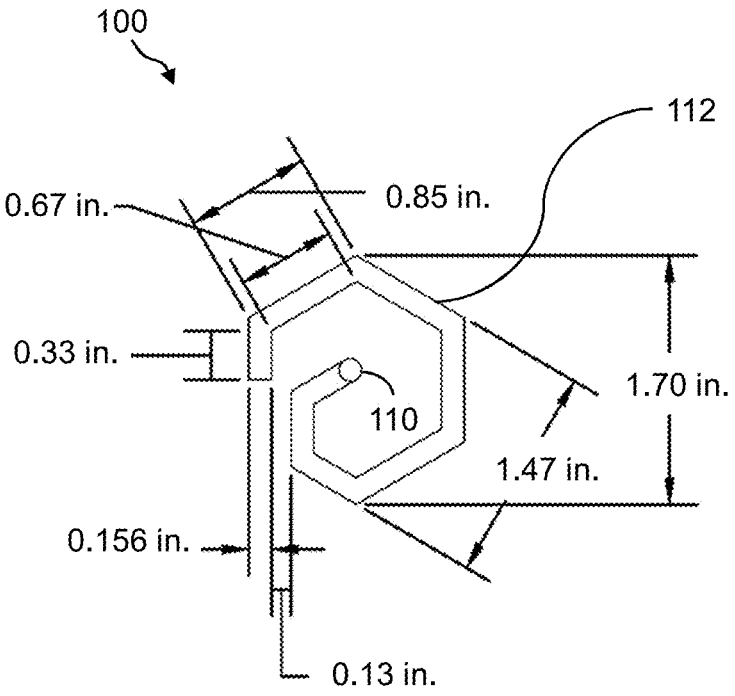
Figure 4B:
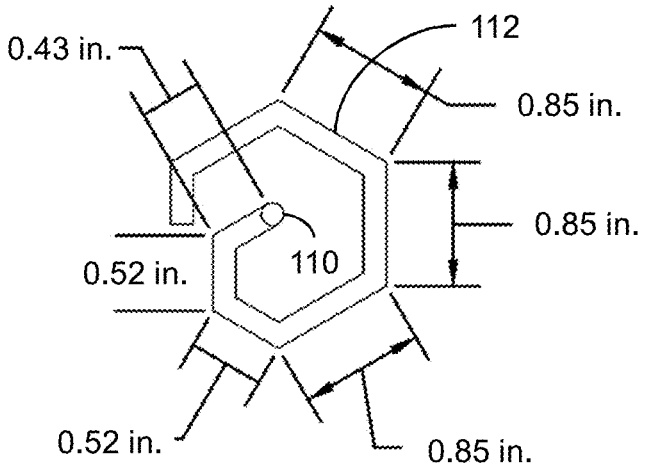
Figure 5A:
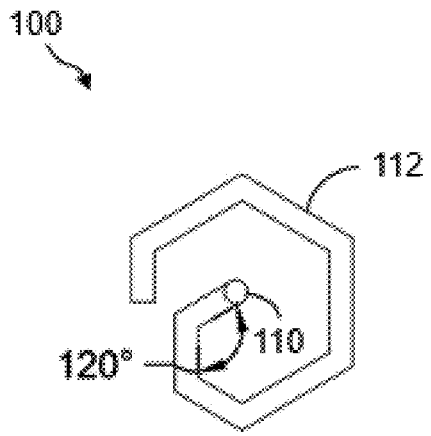
Figure 5B:
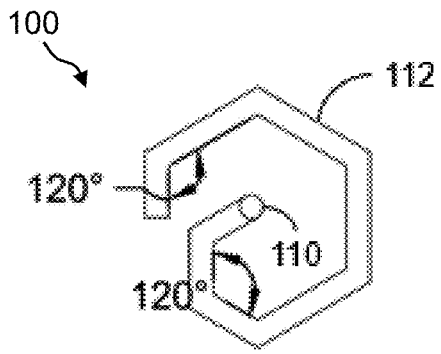
Figure 6:
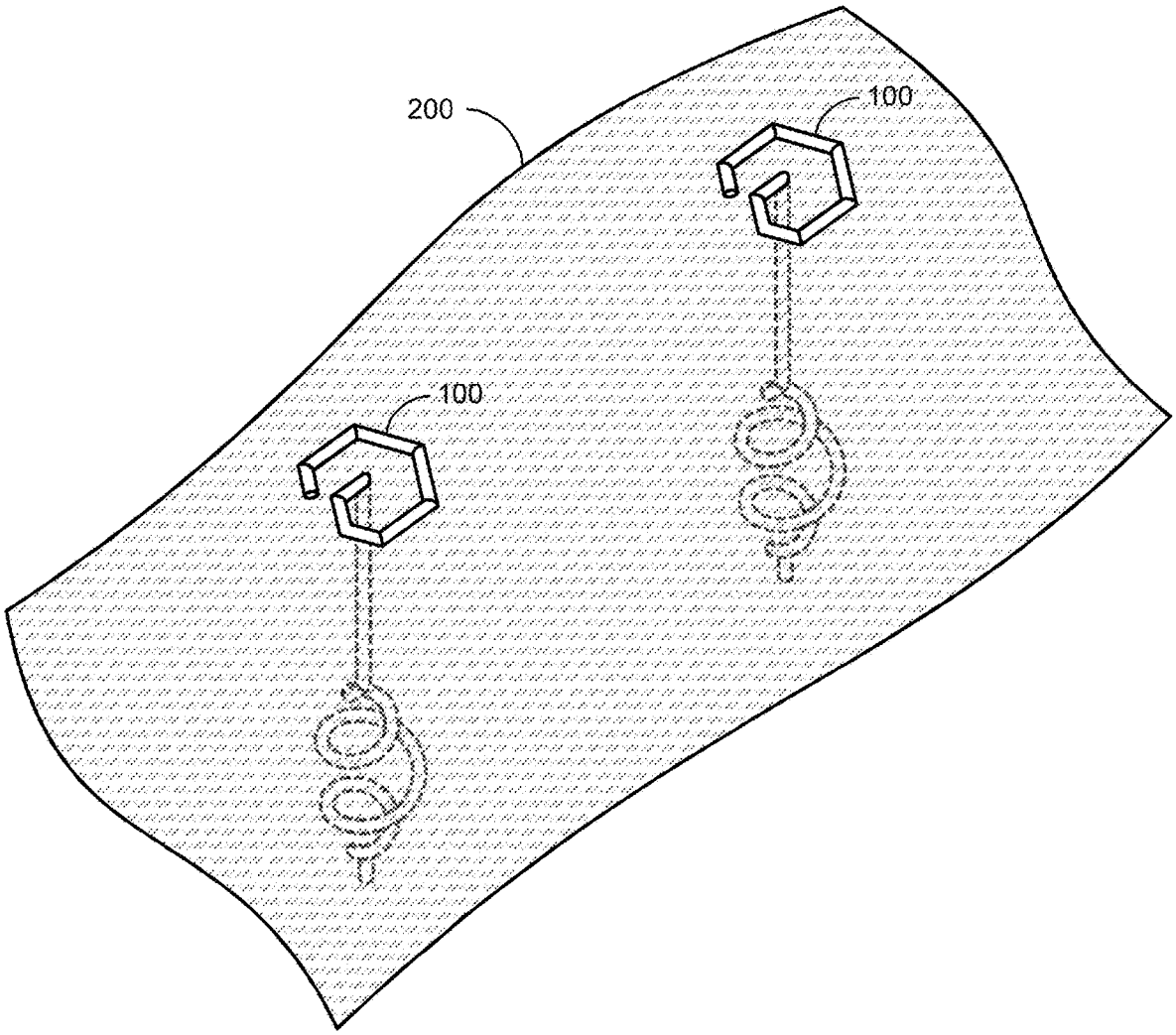
Figure 7:
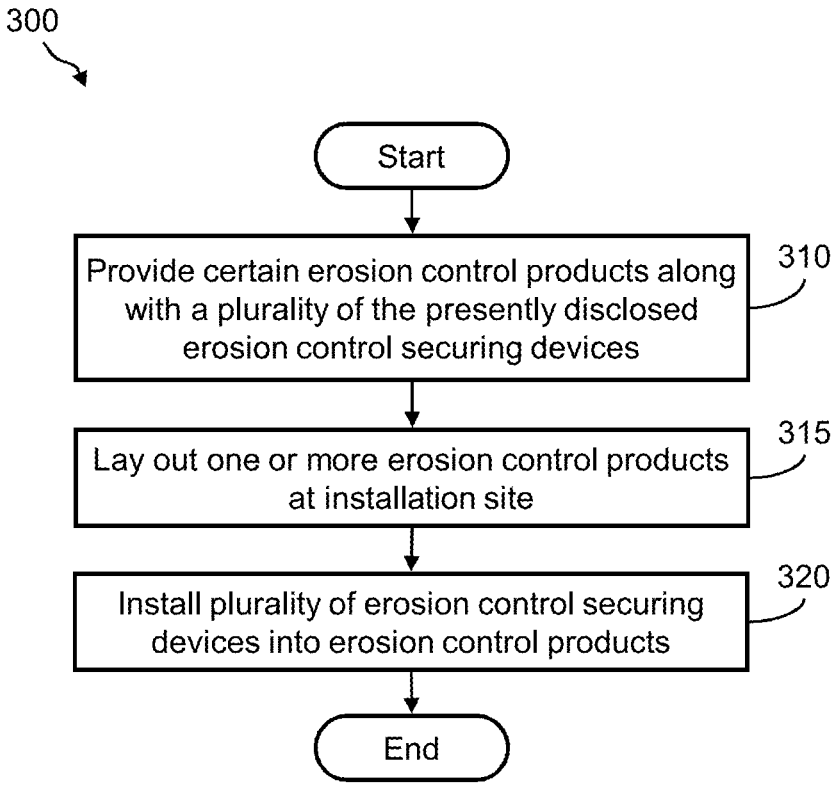
Figure 8A:
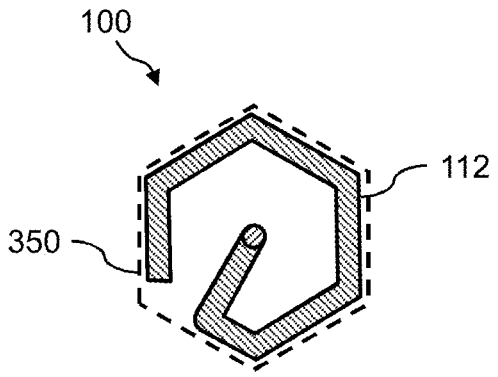
Figure 8B:
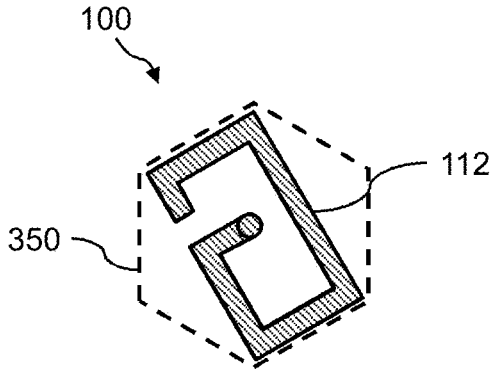
Figure 9A:
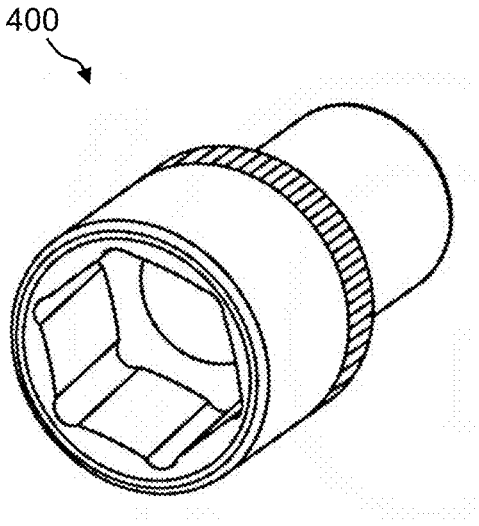
Figure 9B:
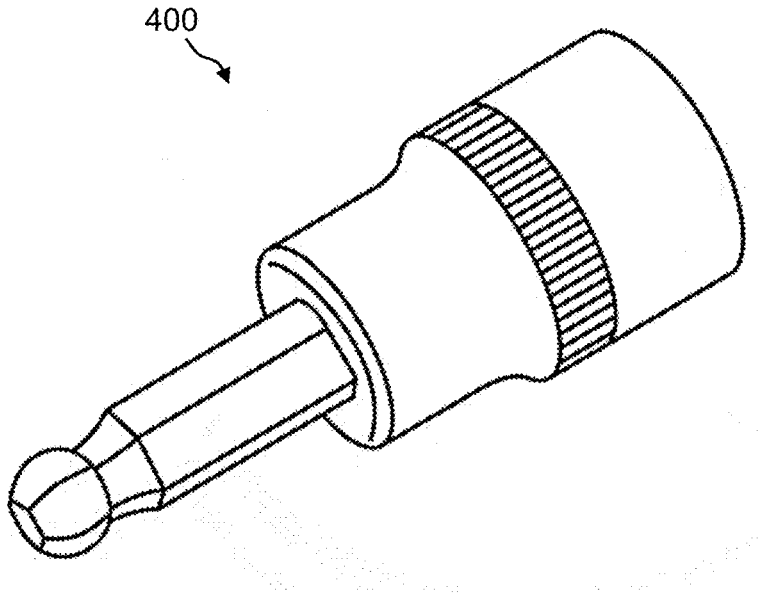
Figure 10:
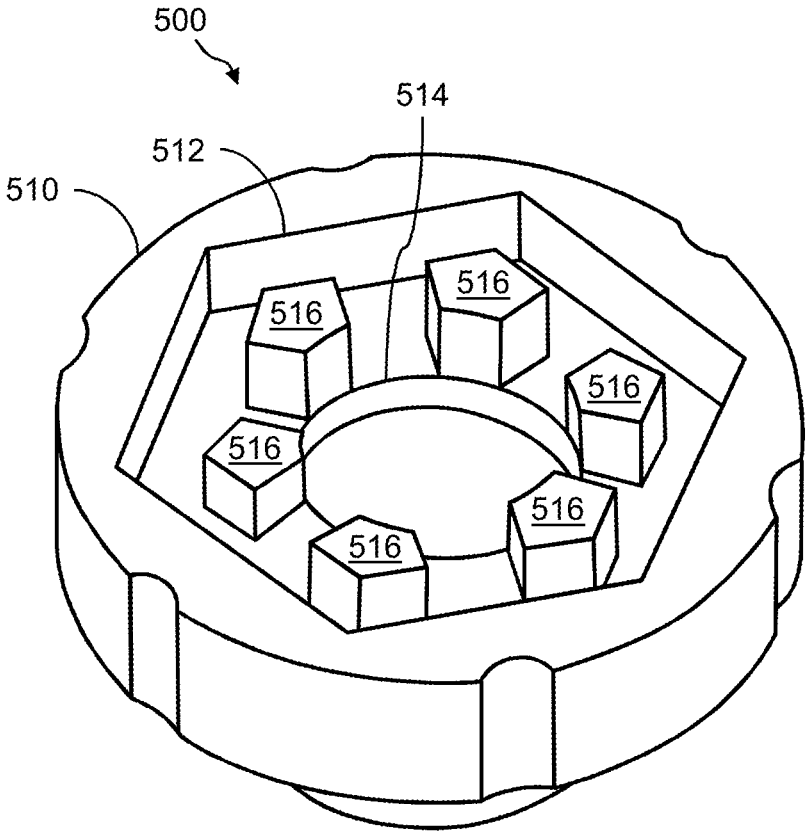
Figure 11:
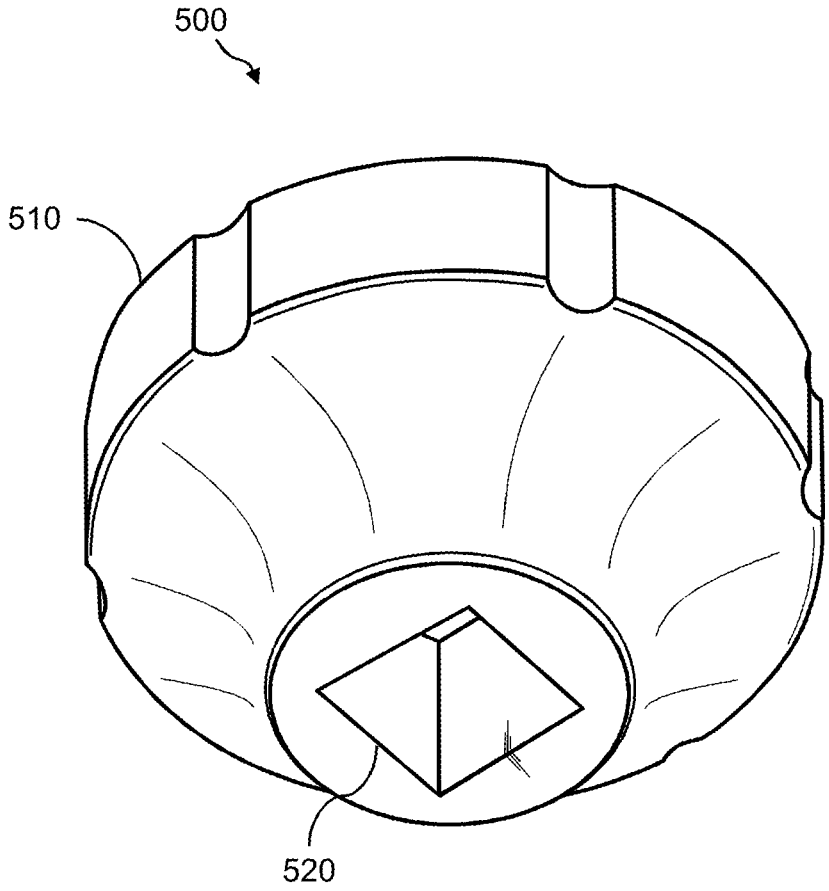
Figure 12:
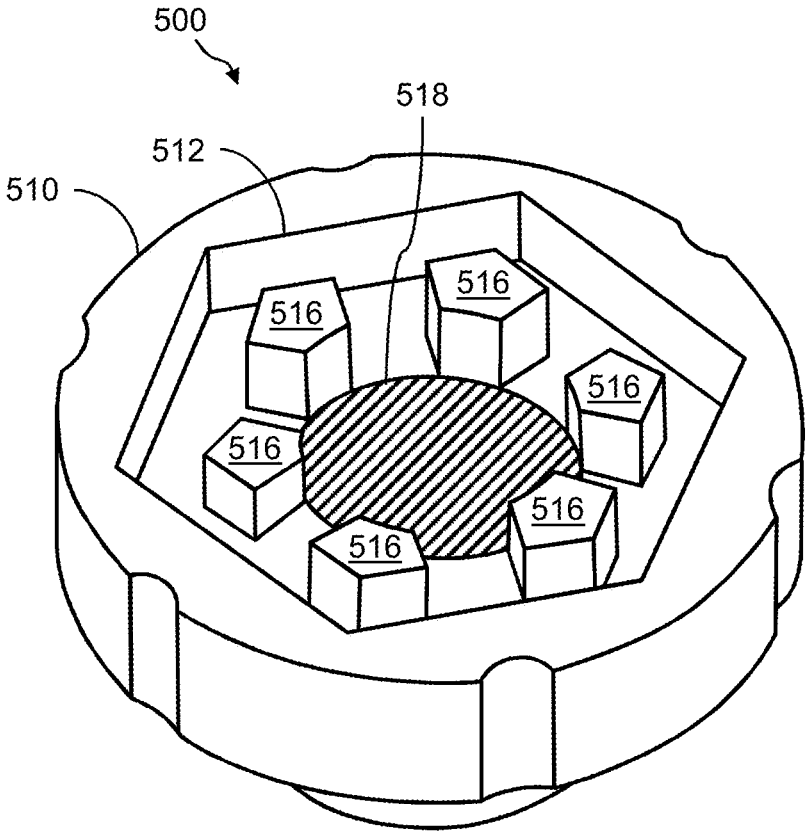
Figure 13:
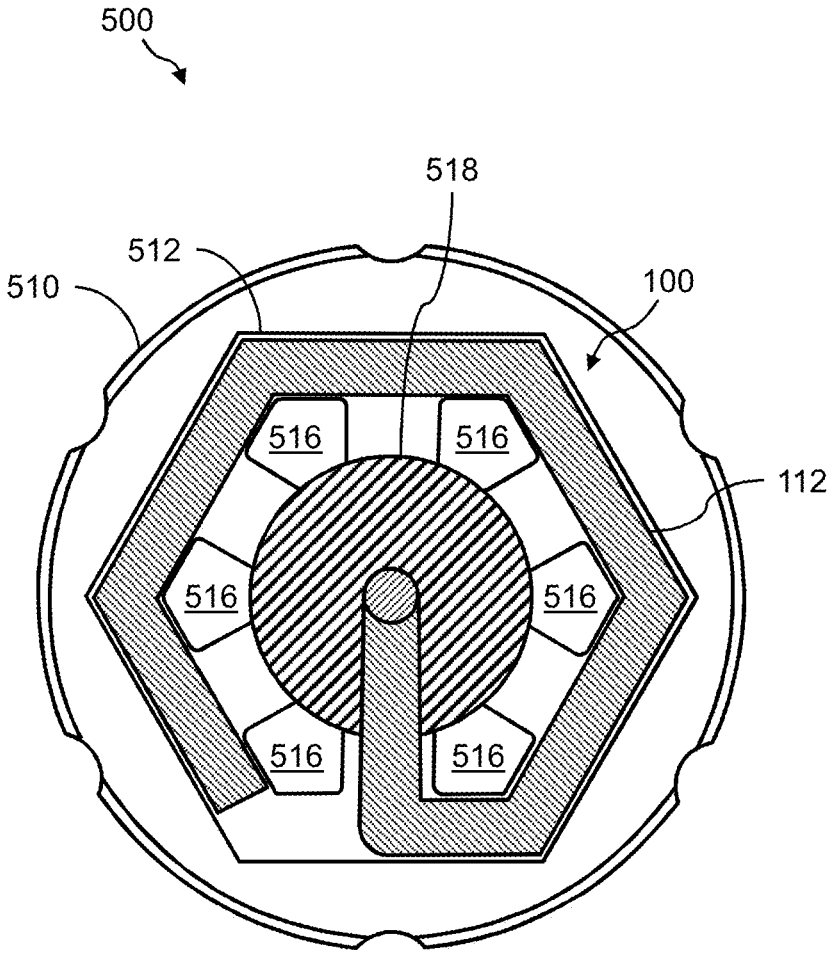
Figure 14:
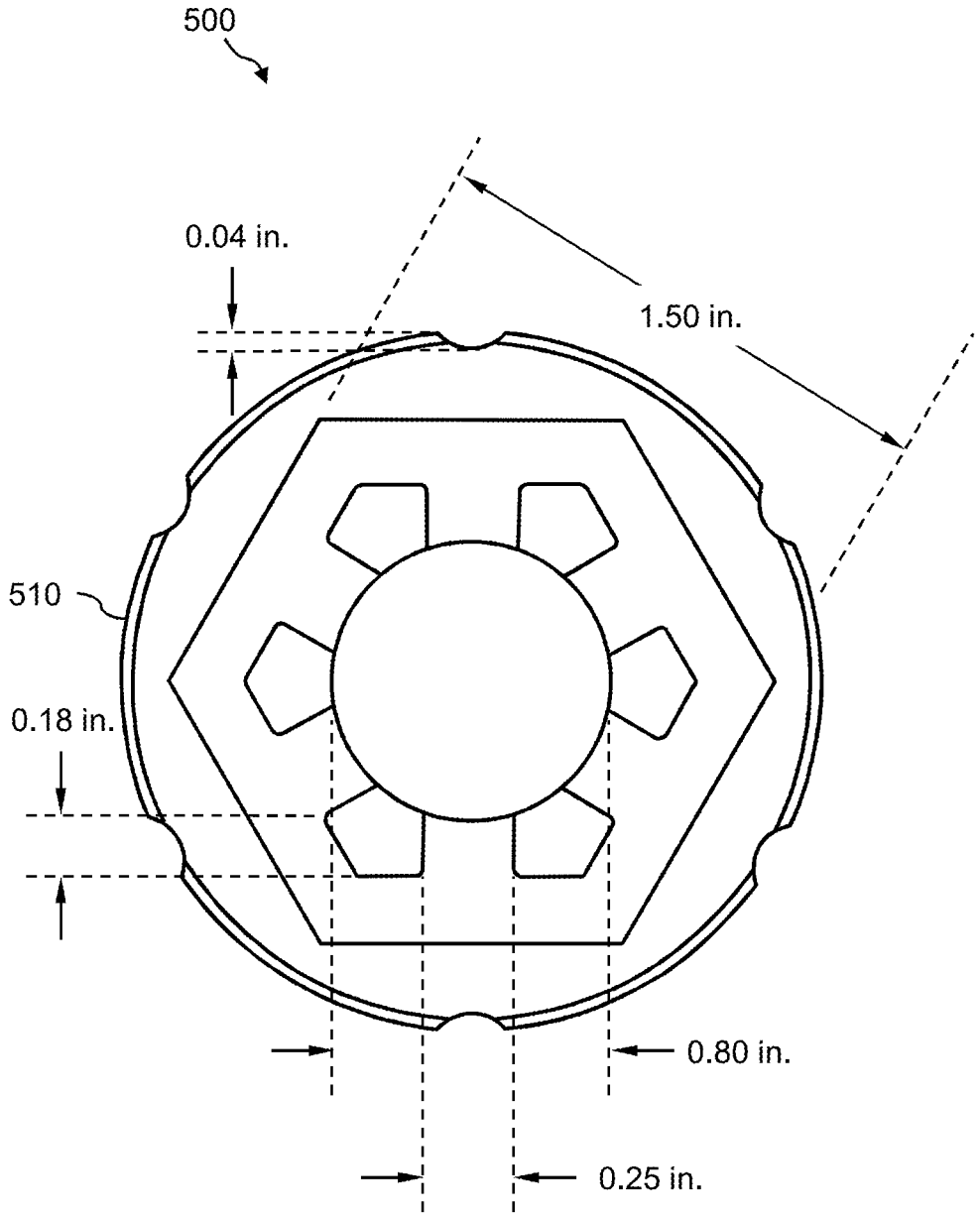
Figure 15:
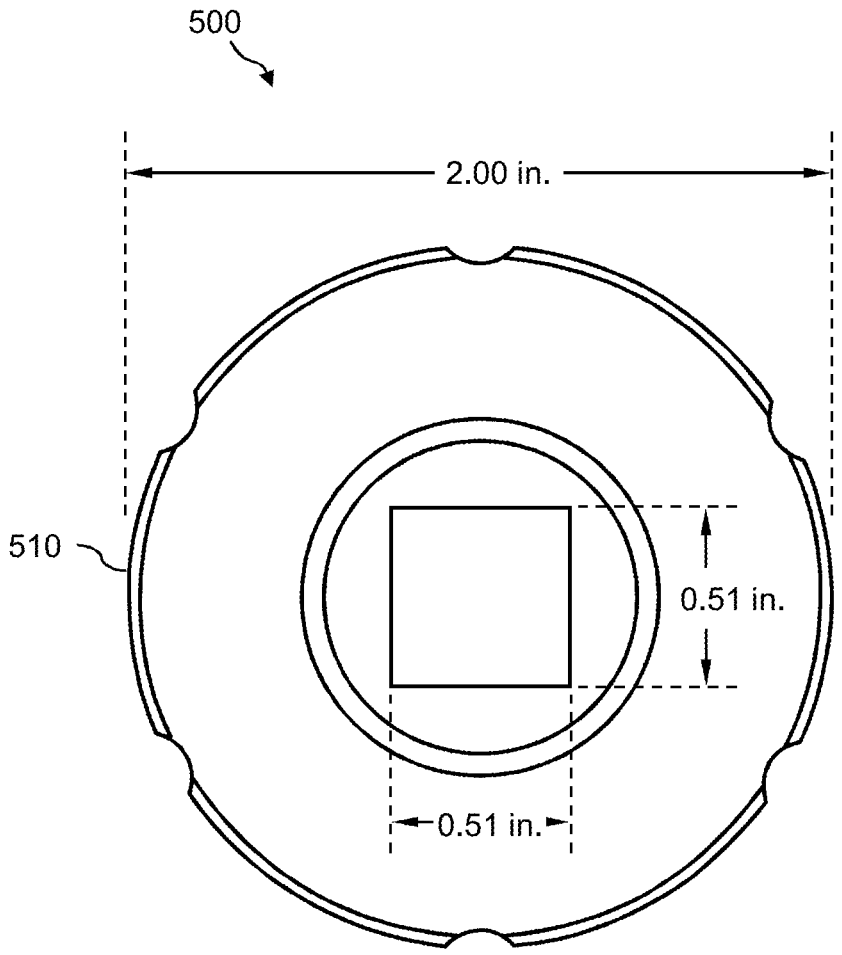
Figure 16:
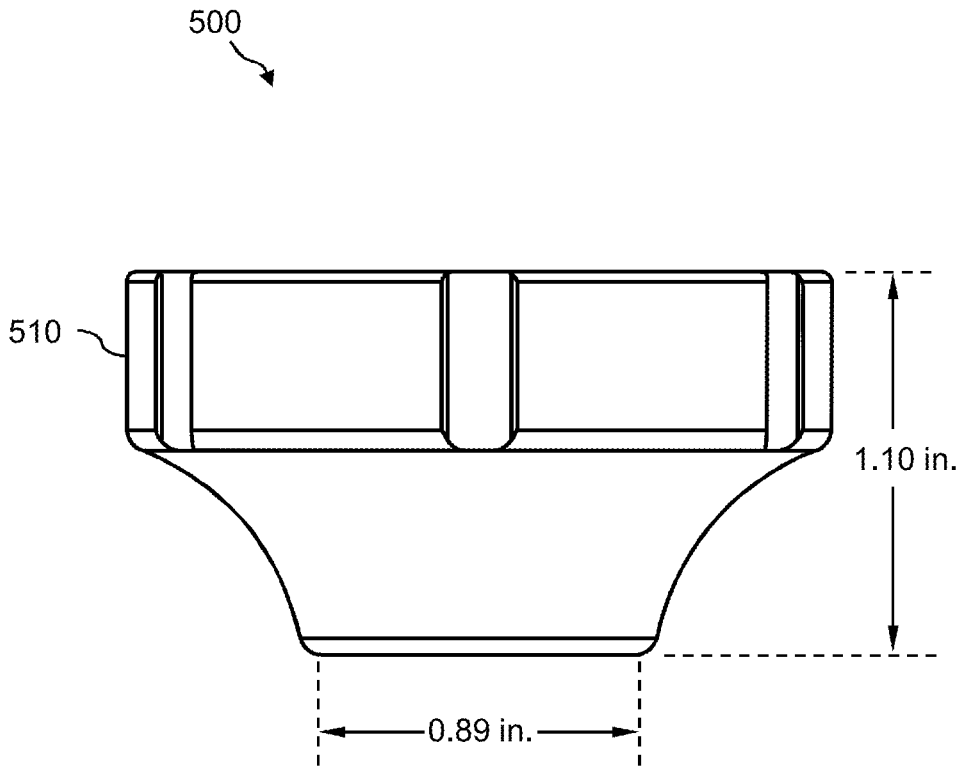

Having thus described the presently disclosed subject matter in general terms, reference will now be made to the accompanying drawings, which are not necessarily drawn to scale, and wherein:

FIG. 1 illustrates a perspective view of an example of the presently disclosed erosion control securing device;

FIGS. 2A-2C illustrate a side view (FIG. 2A) and top views (FIGS. 2B and 2C) of the erosion control securing device shown in FIG. 1;

FIG. 3 illustrates a side view of the erosion control securing device shown in FIG. 1;

FIGS. 4A and 4B illustrate top views of the erosion control securing device shown in FIG. 1 with various measures in accordance with various embodiments;

FIGS. 5A and 5B illustrate additional top views of the erosion control securing device shown in FIG. 1 with various measures in accordance with various embodiments;

FIG. 6 illustrates a perspective view of an example of the erosion control securing device shown in FIG. 1 though FIG. 5B installed in erosion control matting;

FIG. 7 illustrates a flow diagram of an example of a method of using the presently disclosed erosion control securing device for securing erosion control products; and FIG. 8A and FIG. 8B show an example of a hex-shaped head portion and a rectangular-shaped head portion, respectively, of the erosion control securing device in relation to the hexagonal shape of a hex socket drive mechanism;

FIG. 9A and FIG. 9B show perspective views of an example of a drive mechanism that may be used for installing the erosion control securing device shown in FIG. 1;

FIG. 10, FIG. 11, and FIG. 12 show perspective views of another example of a drive mechanism that may be used for installing the erosion control securing device shown in FIG. 1;

FIG. 13 shows a plan view of the drive mechanism shown in FIG. 10, FIG. 11, and FIG. 12 in relation to the hex-shaped head portion of the erosion control securing device shown in FIG. 1; and FIG. 14, FIG. 15, and FIG. 16 show a top view, a bottom view, and a side view, respectively, of the drive mechanism shown in FIG. 10, FIG. 11, and FIG. 12 and showing more details thereof.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the present subject matter.

In some embodiments, the presently disclosed subject matter provides an erosion control securing apparatus and method. For example, an erosion control securing device is provided that includes a main shaft with a hexagonal-shaped head portion at its proximal end and a coil portion at its distal end. In one example, the coil portion of the erosion control securing device includes three turns. Further, a main feature of the presently disclosed erosion control securing device is that the hexagonal-shaped head portion may be sized and shaped to engage with a standard hexagonal shaped drive tool, such as a standard hex socket that may be driven by a drill and/or socket wrench.

In some embodiments, the presently disclosed erosion control securing apparatus and method provide a coil portion that includes three turns and wherein the beginning of the coil portion (i.e., beginning of the first turn) has a starting radius, then the radius of the coil portion symmetrically increases to a maximum radius at the second turn, and then the radius symmetrically decreases back to the starting radius at the ending of the coil portion (i.e., ending of the third turn).

In some embodiments, the presently disclosed erosion control securing apparatus and method provide a head portion of any shape that may be engaged with a standard hexagonal shaped drive tool, such as a standard hex socket. For example, the head portion may be hexagonal-shaped, rectangular-shaped, or bowtie-shaped as long as it is sized to engage in driving fashion to a standard hexagonal shaped drive tool, such as a standard hex socket.

In some embodiments, the presently disclosed erosion control securing apparatus and method provide a custom drive mechanism, such as a custom hex socket that may be designed to receive the hexagonal-shaped head portion of the erosion control securing device and that may include a magnet for holding the hexagonal-shaped head portion of the erosion control securing device within the drive mechanism by magnet forces.

Referring now to FIG. 1 is a perspective view of an example of the presently disclosed erosion control securing device 100. Erosion control securing device 100 may include a main shaft 110. A head portion 112 is provided on the proximal end of a main shaft 110. Head portion 112 is substantially hexagonal in shape (see FIG. 8) and is hereafter called HEX head portion 112. HEX head portion 112 has a head transition segment 114 for transitioning to main shaft 110. Main shaft 110 is arranged substantially normal to the plane of HEX head portion 112. A coil portion 116 is provided at the distal end of a main shaft 110. A coil transition segment 120 is provided between the distal end of main shaft 110 and the proximal end of coil portion 116.

Further, a tip 122 is provided at the distal end of coil portion 116. A tip transition segment 121 may be provided between the distal end of the coil portion 116 and the proximal end of the tip 122.

In one example, shown in FIG. 2A-2C, coil portion 116 may include three turns 118, starting with a beginning sized turn 118*a*, then transitioning to a larger sized turn 118*b*, then transitioning back to a beginning sized turn 118*c*. Additionally, FIG. 2A-2C shows a side view, a top view, and a simplified top view of erosion control securing device 100 shown in FIG. 1. In FIG. 2C, coil portion 116 is omitted.

The members forming erosion control securing device 100 connect one to another in a substantially continuous manner. Further, the members forming erosion control securing device 100 may be substantially tubular or rod-like members having a radius, for example, of about 0.156 inches. Erosion control securing device 100 may be formed of any rigid, strong, and durable material that is able to withstand installation in the soil for an extended period of time. Erosion control securing device 100 may be formed, for example, of metal; galvanized metal; plastic; and biodegradable materials.

Referring now to FIGS. 3, 4A-4B, and 5A-5B are various views of erosion control securing device 100 shown in FIG. 1 and showing more details thereof. Namely, FIGS. 3, 4A-4B, and 5A-5B show example dimensions and/or angles of erosion control securing device 100. In FIGS. 3, 4A-4B, and 5A-5B all dimensions are in inches. Again, in one example shown in FIG. 3, coil portion 116 may include three turns 118 with a starting radius at turn 118*a* of about 0.156 inches, then symmetrically increasing to a radius at turn 118*b* of about 0.625 inches, then symmetrically decreasing back to a radius at turn 118*c* of about 0.156 inches. Coil transition segment 120 may be, for example, about 0.16 inches long to provide a transition length from the center of main shaft 110 and the center of coil portion 116. Tip transition segment 121 may also be, for example, about 0.16 inches long to provide a transition length from the center of coil portion 116 to the center of tip 122. Tip 122 may be about 0.44 inches long.

In one example, the dimensions of HEX head portion 112 are shown in FIGS. 4A-4B and 5A-5B. The HEX head portion 112 includes adjoining segments that are arranged to form a hexagonal shape with internal angles of about 120° between one segment and the adjacent segment. A terminal end segment of the HEX head portion 112 may be about 0.33 inches long. Adjacent to the end segment are four central segments that are each approximately the same length of about 0.85 inches at the outer periphery of the segment and about 0.67 inches at the inner periphery of the segment. The length of the widest part of the HEX head portion, or the length between the opposing tips of three adjoining central segments is about 1.70 inches. The length between opposing tips of two adjoining central segments is about 1.47 inches. Head transition segment 114 between the central segments and the main shaft 110 may include approximately three adjoining segments, shorter than the central segments, that include internal angles of about 120°. The first two of the head transition segments are adjacent to a central segment, and are each approximately 0.52 inches in length. The last of the three head transition segments adjacent to the main shaft 110 is approximately 0.43 inches. The HEX head portion 112 in this example does not form a closed hexagonal shape, and includes an opening between the terminal end segment and the head transitional segment 114. That opening is about 0.13 inches in length.

The overall dimensions of erosion control securing device 100 may vary. For example, the 4.25-inch length of main shaft 110 and/or the 3-inch length of coil portion 116 may vary. Accordingly, the overall 8.156-inch length of erosion control securing device 100 may vary. A main feature of erosion control securing device 100 is that HEX head portion 112 is sized and shaped to engage with a standard hexagonal shaped drive tool, such as a "HEX socket" (see FIG. 9A through FIG. 16).

However, the configuration of erosion control securing device 100 shown in FIGS. 3, 4A-4B, and 5A-5B is exemplary only. For example, the overall length of erosion control securing device 100 may range from about 6 inches to about 12 inches. Further, coil portion 116 of erosion control securing device 100 may include from about one to about three turns 118. Further, the radius of turns 118 may range from about 0.125 inches to about 1.25 inches.

Referring now to FIG. 6 is a perspective view of an example of an erosion control securing system including an erosion control securing device 100 shown in FIG. 1 though FIG. 5B installed in an erosion control matting 200 such as by an erosion control drive mechanism (see FIG. 10).

Referring now to FIG. 7 is a flow diagram of an example of a method 300 of using the presently disclosed erosion control securing device 100 for securing erosion control products. Method 300 may include, but is not limited to, the following steps.

At a step 310, certain erosion control products along with a plurality of the presently disclosed erosion control securing devices are provided. For example, one or more erosion control mattings 200 (see FIG. 6) and a plurality of erosion control securing devices 100 as shown in FIG. 1 though FIG. 5B are provided at an installation job site.

At a step 315, one or more erosion control products are laid out at an installation job site. For example, one or more erosion control mattings 200 (see FIG. 6) are laid out at the installation job site.

At a step 320, a plurality of the presently disclosed erosion control securing devices are installed into the erosion control products. For example, a plurality of erosion control securing devices 100 as shown in FIG. 1 though FIG. 5B are installed into one or more erosion control mattings 200, as shown in FIG. 6.

Referring now to FIG. 8A and FIG. 8B is an example of a hex-shaped head portion 112 and a rectangular-shaped head portion 112, respectively, of the erosion control securing device 100 in relation to the hexagonal shape of a hex socket drive mechanism. For example, FIG. 8A shows an example of another variation of the hex-shaped head portion 112 of erosion control securing device 100 in relation of a hexagonal shape 350. Hexagonal shape 350 may be representative of the shape of a standard hex socket that may be used to drive erosion control securing device 100.

Further, head portion 112 of drive erosion control securing device 100 is not limited to hexagonal shape only and still be driven by a standard hex socket. For example, FIG. 8B shows an example of a rectangular-shaped head portion 112 in relation of hexagonal shape 350. In this example, the rectangular-shaped head portion 112 may be sized for fitting into and engaging in driving fashion with a hex socket drive mechanism, such as those described hereinbelow with reference to FIG. 9A through FIG. 16. In another example, head portion 112 may have a "bowtie" shape (not shown) that may be sized for fitting into a hex socket drive mechanism.

Referring now to FIG. 9A and FIG. 9B that are perspective views of an example of a drive mechanism that may be used for installing erosion control securing device 100 shown in FIG. 1. In one example the drive mechanism can be incorporated into an erosion control securing kit. In this example, the drive mechanism may be a HEX socket 400. HEX socket 400 may be used to rotationally drive erosion control securing device 100. In one example, HEX socket 400 may be a standard 1.5-inch HEX socket that can be installed in the chuck of a hand tool or of a power tool, such as a standard drill. Once engaged, HEX socket 400 may be driven manually by hand or with the power tool to install erosion control securing device 100.

Referring now to FIG. 10, FIG. 11, and FIG. 12 is perspective views of another example of a drive mechanism that may be used for installing erosion control securing device 100 shown in FIG. 1. In this example, the drive mechanism may be a HEX socket 500. In one example, HEX socket 500 may be a custom ½-inch drive or ⅜-inch drive socket that may be used with a standard ½-inch drive or ⅜-inch drive socket wrench. In this example, HEX socket 500 may be designed to receive the hex-shaped head portion 112 of erosion control securing device 100.

HEX socket 500 may include, for example, a body 510 that has a hex-shaped recess 512 in one, top side (see FIG. 10) and a socket wrench receiver 520 on the opposite, bottom side (see FIG. 11). Another substantially circular recess 514 is provided at about the center portion of hex-shaped recess 512. Further, an arrangement (e.g., six) of engaging features 516 are provided within hex-shaped recess 512 and around circular recess 514. Hex-shaped recess 512 with engaging features 516 may be designed to receive hex-shaped head portion 112 of erosion control securing device 100. Further, a magnet 518 may be installed in circular recess 514 of hex-shaped recess 512 (see FIG. 12).

Referring now to FIG. 13 is a plan view of HEX socket 500 shown in FIG. 10, FIG. 11, and FIG. 12 in relation to hex-shaped head portion 112 of erosion control securing device 100 shown in FIG. 1. In addition to being engaged and secured within the six sides of the hex-shaped recess 512 and the engaging features 516, the center portion of hex-shaped head portion 112 may be held within HEX socket 500 by the magnetic forces of magnet 518. The arrangement of HEX socket 500 allows gripping of the outer portion of hex-shaped head portion 112 during driving, which is more stable and allows for more torque transfer than prior art driving device and anchoring systems. The engaging features 516 of the socket are not used to drive the securing device 100, rather, they serve to reduce wobble in installation, minimizing the rotation of the securing device 100 in the socket 500, a further improvement on the prior art.

Further, FIG. 14, FIG. 15, and FIG. 16 show a top view, a bottom view, and a side view, respectively, of HEX socket 500 shown in FIG. 10, FIG. 11, and FIG. 12 and showing more details thereof. For example, FIG. 14, FIG. 15, and FIG. 16 show example dimensions (in inches) of HEX socket 500. In one example, the radius of the center portion of HEX socket 500 may be about 0.80 inches. The distance between each engaging feature 516 may be about 0.25 inches. Each engaging feature may be angled, and approximately pentagonal in shape, with four substantially flat sides, and one curved side that is adjacent to the central portion. The two outer most, flat sides in relation to the curved side may each be about 0.18 inches in length. The length of two adjoining sides of the hex-shaped recess 512 may be about 1.50 inches. The outer walls of the top side of the body 510 may include an arrangement of grooves. Each groove may have a depth of about 0.04 inches. The overall length of the body 510 may be about 1.10 inches, the overall width of the top side of the body is about 2.00 inches, and the overall width of the bottom side of the body 510 is about 0.89 inches. The length and width of the socket wrench receiver 520 are about 0.51 inches, respectively. However, the configuration and dimensions of HEX socket 500 shown in FIGS. 10-16 are exemplary only.

Referring now again to FIG. 1 through FIG. 16, the presently disclosed erosion control securing device 100 and method 300 is not limited to use with erosion control products. This is exemplary only. The presently disclosed erosion control securing device 100 and method 300 may be used in any application for securing an item into the ground. For example, erosion control securing device 100 may be used as a tent stake; canopy stake; hunting blind stake; any stake to which a rope, cord, or strap may be tied; and the like.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the present subject matter.

What is claimed is:

1. An erosion control securing system kit, comprising:

an erosion control securing device comprising: a main shaft having a main shaft proximal end and a main shaft distal end; a head portion at the main shaft proximal end, the head portion being substantially hexagonal in shape; and a coil portion at the main shaft distal end; and a rotational drive mechanism for installing the securing device, wherein the rotational drive mechanism comprises:

a socket with a body having a recess on one side, the recess being substantially hexagonal in shape and dimensioned to receive the head portion, wherein the substantially hexagonal recess includes a central recess that is substantially circular;

a magnet within the central recess; and an arrangement of engaging features within the substantially hexagonal recess and surrounding the central recess, wherein the arrangement of engaging features each extend from the central recess to the head portion in an instance in which the head portion is received by the recess.

2. The securing system kit of claim 1, wherein the body has a socket wrench receiver on a side opposing the one side.

3. The securing system kit of claim 1, wherein the coil portion has three turns, with a first turn of the three turns having a first radius, a second turn of the three turns having a radius larger than the first radius, and a third turn of the three turns having a radius the same as the first radius.

4. The securing system kit of claim 3, wherein the first radius is about 0.156 inches and the second radius is about 0.675 inches.

5. The securing system kit of claim 4, wherein the three turns each has a radius ranging from about 0.125 inches to about 1.25 inches.

6. The securing system kit of claim 1, wherein the main shaft, the head portion, and the coil portion are connected in a substantially continuous matter.

7. The securing system kit of claim 6, wherein the main shaft, the head portion, and the coil portion are substantially tubular with a radius of about 0.156 inches.

8. The securing system kit of claim 1, further comprising a head transition segment between the head portion and the main shaft proximal end, wherein the main shaft is arranged substantially normal to a plane of the head portion.

9. The securing system kit of claim 8, further comprising a coil transition segment between the main shaft distal end and the proximal end of the coil portion, a tip at the distal end of the coil portion, and a tip transition segment between the distal end of the coil portion and the proximal end of the tip.

10. The securing system kit of claim 9, wherein the tip is about 0.44 inches long, wherein the coil transition segment is about 0.16 inches long, and wherein the tip transition segment is about 0.16 inches long.

11. The securing system kit of claim 9, wherein an overall length of the securing device is about 8.156 inches, wherein the main shaft is about 4.25 inches long, and wherein the coil portion is about 3.00 inches long, and wherein a width of the head portion is about 1.47 inches.

12. The securing system kit of claim 9, wherein the head portion is formed by adjoining segments, the adjoining segments including a terminal end segment next to four central segments next to a head transition segment, the head transition segment connected to the main shaft, wherein the head transition segment is spaced apart from the terminal end segment.

13. The securing system kit of claim 12, wherein the terminal end segment is about 0.33 inches long, and wherein the four central segments are each about 0.85 inches long.

14. The securing system kit of claim 12, wherein the head transition segment includes three adjoining segments, a first segment of the three adjoining segments being connected to one of the four central segments, a second segment of the three adjoining segments, wherein a length of the second segment being about the same length as a length of the first segment of the three adjoining segments, and a third segment of the three adjoining segments being connected to the main shaft.

15. A method for using an erosional control securing system, comprising:

providing an erosion control securing device comprising: a main shaft having a main shaft proximal end and a main shaft distal end; a head portion at the main shaft proximal end, the head portion being substantially hexagonal in shape; and a coil portion at the main shaft distal end;

providing a matting material;

laying out the matting material over an area;

installing the securing device into the matting material to secure the matting material to the area, wherein the head portion is on one side of the matting material and the main shaft and coil portion are on an opposing side of the matting material, wherein the securing device is installed into the matting material by a rotational drive mechanism for installing the securing device, wherein the rotational drive mechanism comprises:

a socket with a body having a recess on one side, the recess being substantially hexagonal in shape and dimensioned to receive the head portion, wherein the substantially hexagonal recess includes a central recess that is substantially circular;

a magnet within the central recess; and an arrangement of engaging features within the substantially hexagonal recess and surrounding the central recess, wherein the arrangement of engaging features each extend from the central recess to the head portion in an instance in which the head portion is received by the recess.

16. The method of claim 15, wherein the body has a socket wrench receiver on a side opposing the one side.

17. The method of claim 15, wherein the coil portion has three turns, with a first turn of the three turns having a first radius, a second turn of the three turns having a radius larger than the first radius, and a third turn of the three turns having a radius the same as the first radius.

* * * * *